US006841948B2

(12) United States Patent
Yoshida

(10) Patent No.: US 6,841,948 B2
(45) Date of Patent: Jan. 11, 2005

(54) DEVICE FOR DRIVING LUMINESCENT DISPLAY PANEL

(75) Inventor: Takayoshi Yoshida, Yonezawashi (JP)

(73) Assignee: Tohoku Pioneer Corporation, Tendo (JP)

( * ) Notice: Subject to any disclaimer, the term of this patent is extended or adjusted under 35 U.S.C. 154(b) by 0 days.

(21) Appl. No.: 10/665,318

(22) Filed: Sep. 22, 2003

(65) Prior Publication Data

US 2004/0056605 A1 Mar. 25, 2004

(30) Foreign Application Priority Data

Sep. 25, 2002 (JP) ..... 2002-278928

(51) Int. Cl.[7] ..... G09G 3/30
(52) U.S. Cl. ..... 315/169.3; 345/76
(58) Field of Search ..... 315/169.1, 169.3, 315/77; 345/76

(56) References Cited

U.S. PATENT DOCUMENTS 6,583,581 B2 * 6/2003 Kaneko et al. ..... 315/169.3
6,774,877 B2 * 8/2004 Nishitoba et al. ..... 345/76

FOREIGN PATENT DOCUMENTS

| | | |
|---|---|---|
| JP | 9-232074 | 9/1997 |
| JP | 2001-109432 | 4/2001 |
| JP | 2001-117534 | 4/2001 |

* cited by examiner

*Primary Examiner*—David Vu
(74) *Attorney, Agent, or Firm*—Westerman, Hattori, Daniels & Adrian, LLP

(57) ABSTRACT

Provided is a device for driving an active matrix type luminescent display panel, which can effectively apply a reverse bias voltage to a luminescent element via a drive TFT. A luminescent element 14 constituting one pixel 10 is light-up driven by a control TFT 11 and a drive TFT 12. A serial circuit of the drive TFT 12 and the luminescent element 14 is connected to a power source circuit via a switch S1 and a switch S2, whereby a state where a forward-directional current is supplied to the luminescent element or a state where a reverse bias voltage is applied to the luminescent element is selected. By using, as the control TFT 11 and the drive TFT 12, TFT of the channel type of that is the same, it is possible to maintain the drive TFT 12 to be in an "on" state when having applied a reverse bias voltage to the luminescent element 14. By doing so, it becomes possible to effectively apply a reverse bias voltage to the luminescent element.

13 Claims, 9 Drawing Sheets

DEVICE FOR DRIVING LUMINESCENT DISPLAY PANEL

BACKGROUND OF THE INVENTION

1. Field of the Invention

The present invention relates to a device for driving a display panel that performs active driving of a luminescent element constituting a pixel by, for example, a TFT (Thin Film Transistor) and, more particularly, to a device for driving a display panel, which enable effectively applying a reverse bias voltage with respect to the luminescent element via a driving TFT.

2. Description of the Related Art

Development of a display that uses a display panel constructed of luminescent elements arranged in the form of a matrix has gone on being widely made. As a luminescent element that is used in such display panel, attention has been drawn toward an organic EL (electroluminescence) element wherein organic material is used in the luminescent layer. One of the reasons therefor is that, by using in a luminescent layer of the EL element an organic compound from which good luminescent property can be expected, the increase in the efficiency and that in the service life which can resist the practical use of the resulting EL element has made their progress.

As the display panel that uses such an organic EL element, two display panels have hitherto been proposed, one being a simple matrix type display panel wherein the EL elements are simply arranged in the form of a matrix and the other being an active matrix type display panel wherein to each of the EL elements arranged in the matrix form there has been added an active element consisting of a TFT. Compared with the former simple matrix type display element, the latter active matrix type display panel enables realizing low power consumption. In addition, it has the property of, for example, its being less in terms of the crosstalk between the pixels. It therefore is suitable especially for a display with a high degree of fineness that constitutes a large screen.

FIG. 1 illustrates an example of a circuit construction that corresponds to one pixel 10 in a conventional active matrix type display panel. Incidentally, the respective terminals, i.e. the source and the drain, of each of the TFTs that will be explained below, operationally, each function as the source or the drain depending on the voltage that is applied to the both terminals. Accordingly, in the following description, it is assumed that the expression "source" or "drain", for convenience of the explanation, be handled as a name that is temporarily determined. Therefore, in the actual operational state in each of the circuit examples, there are also cases where that function is different (is reversed) from that corresponding to the name.

In FIG. 1, a gate G of a control TFT 11 is connected to a scanning line (the scanning line A1) and a source S is connected to a data line (the data line B1). Also, a drain D of the control TFT 11 is connected to a gate G of a drive TFT 12 and is also connected to one terminal of a capacitor 13 for holding electric charge. And a source S of the drive TFT 12 is connected to the other terminal of the capacitor 13 and is also connected to a common anode 16 formed within the panel. Also, a drain D of the drive TFT 12 is connected to an anode of an organic EL element 14 and a cathode of the organic EL element 14 is connected to a common cathode 17 that is formed within the panel.

FIG. 2 typically illustrates a state wherein the circuit construction that constitutes each pixel 10 illustrated in FIG. 1 is arrayed in a display panel 20. In each of the intersections of the respective control lines A1 to An and the respective data lines B1 to Bm, there is formed the pixel 10 having the circuit construction illustrated in FIG. 1. And, in the above-described construction, each source S of the drive TFTs 12 is respectively connected to the common anode 16 illustrated in FIG. 2 and the cathode of the respective EL elements 14 is connected to the common cathode 17 similarly illustrated in FIG. 2.

When, in this state, an "on" voltage is supplied to the gate G of the control TFT 11 of FIG. 1, the TFT 11 causes an electric current, corresponding to the voltage supplied from the data line to the source S, to flow from the source S to the drain D. Accordingly, during a time period in which the gate G of the TFT 11 has the voltage made "on", the capacitor 13 is electrically charged, and the voltage is supplied to the gate G of the TFT 12. Thereby, the TFT 12 causes the electric current based on the gate voltage and the drain voltage to flow from the drain D into the common cathode 17 through the EL element 14 to thereby cause luminescence of the EL element 14.

Also, when the gate G of the TFT 11 has the voltage made "of f", the TFT 11 becomes a so-called state of "cut-off", with the result that the drain D of the TFT 11 becomes an open state. However, the drive TFT 12 has the voltage of its gate G held by the charge accumulated in the capacitor 13, thereby the drive current is maintained until the next scan is performed, thereby the luminescence of the EL element 14 is also maintained. Incidentally, since in the drive TFT 12 there exists the gate input capacitance, even if the capacitor 13 is not provided separately in particular, it is possible to cause the performance of the same operation as stated before.

In the conventional example illustrated in FIGS. 1 and 2, illustration is made of an example of display panel of a so-called "mono-chromatic luminescence" type, wherein, in every pixel, a serial circuit consisting of the drive TFT 12 and EL element 14 constituting a pixel is connected to between the common anode electrode 16 and the common cathode electrode 17. However, the device for driving a luminescent display panel that will be explained below can not only be of course adopted in a mono-chromatic luminescent display panel but can rather suitably be also adopted in, for example, a full-color type luminescent display panel that is equipped with respective luminescent pixels (sub-pixels) of R (red), G (green), and B (blue). Accordingly, in this case, without utilizing the common anode electrode 16 and the common cathode electrode 17 such as those described above, there is adopted a construction that is equipped with anode electrode lines or cathode electrode lines that are respectively separately provided correspondingly to the sub-pixels of R, G, and B.

Incidentally, it is known that the above-described organic EL element, saying from the electrical point of view, has a luminescent element having a diode characteristic and an electrostatic capacitance (parasitic capacitance) connected in parallel with respect thereto. Also, the organic EL element luminesces with a luminance that is almost proportionate to the magnitude of a forward-directional current having the diode characteristic. It is also empirically known that, in the above-described EL element, by sequentially applying a voltage of backward direction having no relevancy to the luminescence (backward bias voltage), the service life of the EL element can be extended.

In view thereof, in Patent document 1, there is disclosed a device for driving a luminescent display panel that is constructed in the way that, for example, within an addressing time period that designates the EL element that is to be lit up, so that a bias voltage of the polarity which is reverse to a forward-directional bias voltage is applied to the EL element. Also, in Patent document 2, there is also disclosed a device for driving a luminescent display panel in which, within a light-up time period of the EL element in the first sub-field (SF1) that starts from the terminating point in time of the addressing time period, there is set a time period (Tb) for simultaneously applying a reverse bias voltage to every EL element.

Patent document 1: Japanese Patent Application Laid-Open No. 2001-109432 (the paragraphs Nos. 0005 to 0007 described in FIGS. 5 and 6 and the like).

Patent document no. 2: Japanese Patent Application Laid-Open No. 2001-117534 (the paragraphs Nos. 0020 to 0023 described in FIGS. 8 and 10 and the like).

By the way, for performing active matrix driving of the above-described current drive-type luminescent element, it is said that a considerably high degree of electron mobility is necessary. For driving it, generally, there is used a polysilicon TFT. And, the relevant construction for performing that driving is generally as follows. Namely, in the drive TFT 12, by reason of the structure of the EL element 14, etc., there is used a P-channel type, and, in the control TFT 11, for ensuring a prescribed holding period by a small holding capacity, there is used an N-channel type that has a leak current that is small when turned off. In case where a thought is given of a construction wherein a combination of the above-described P-channel and N-channel TETs is adopted and, thereby, a reverse bias voltage can be applied to the EL element, the circuit constructions of the respective pixels such as those which are illustrated in, for example, FIGS. 3 to 7 can be taken up as examples. Incidentally, in FIGS. 3 to 7 that will be explained below, the elements that correspond to those illustrated in FIG. 1 are denoted by the same reference symbols.

First, the circuit construction of FIG. 3 is the one that is called a so-called "conductance control system" that is the same as the circuit construction explained in FIG. 1. And, by selecting the potential on the cathode side of the EL element 14 by a switch S1, a relevant construction is made so that a forward-directional voltage, or a reverse bias voltage, may be supplied to the EL element 14. In this case, in case where applying a forward-directional voltage to the EL element 14, the potential between the source of the drive TFT 12 and the cathode of the EL element 14 is set to be 15 V or so. Therefore, the potential of a VHanod illustrated in FIG. 3 is set to be 10 V while the potential of a VLcath is set to be −5 V or so. As a result of this, in a state where the switch S1 illustrated in FIG. 3 is in the illustrated state, it is possible to apply a forward-directional voltage to the EL element 14.

On the other hand, in case where supplying, in the circuit construction illustrated in FIG. 3, a reverse bias voltage to the EL element 14, the switch Si is changed over to a direction opposite to that illustrated, and, thereby, a VHbb is selected. In this case, the necessity arises of preparing, for the potential of the VHbb, a voltage source the potential of that is again higher than the potential of the VHanod, 10V. For instance, if attempting to apply a reverse bias voltage of 15 V to between the source of the drive TFT 12 and the cathode of the EL element 14, a voltage of 25 V becomes needed as the voltage level of VHbb.

Next, FIG. 4 illustrates an example of the 3-TFT type pixel construction for realizing the digital gradation. In the construction illustrated in FIG. 4, there is equipped an erasing TFT 21. By turning on that erasing TFT 21 during the light-in period of the EL element 14, it is possible to electrically discharge the electric charge of a capacitor 13. By this, it is possible to realize gradation driving for controlling the light-up period of the EL element 14. In this construction, as well, of FIG. 4, by selecting the potential on the cathode side of the EL element 14 by the switch S1, the construction is made so that a forward-directional voltage, or a reverse bias voltage, may be supplied to the EL element 14.

In the circuit construction, as well, illustrated in FIG. 4, if applying a reverse bias voltage of, for example, 15 V to between the source of the drive TFT 12 and the cathode of the EL element 14, it becomes necessary to use a power source for producing as the VHbb a voltage level of 25V.

Ensuring a power source voltage that has a level that is as relatively high as 25 V illustrated as the VHbb in the above-described way is not advisable when a consideration is given of loading the device into, for example, a portable equipment. Also, for light-up driving this type of active matrix panel, many power source voltages that include not only a signal for controlling the electric current that flows through the drive TFT but also a signal for controlling the control TFT become necessary. Especially, in case where considering loading into the portable equipment as described above, it is preferable, from the viewpoint of the actually mounting space and power consumption, that the number of the power source voltages be minimized and they be commonly used.

In view thereof, as illustrated in FIGS. 5 and 6, in addition to the changeover switch S1 (hereinafter referred to also as "the first switch") there is further equipped a changeover switch S2 (hereinafter referred to also as "the second switch"). By doing so, in case where applying a forward-directional current to the EL element 14, the VHanod=10 V is applied via the second switch S2 to the source of the drive TFT 12 while to the cathode of the EL element 14 there is applied the VLcath=−5 V via the first switch S1. By doing so, a forward-directional voltage can be set to be 15V.

Also, in case where applying a reverse bias voltage to the EL element 14, by utilizing the both power sources, the VHanod=10 V and VLcath=−5V, the VLcath=−5 V can be applied to the source of the drive TFT 12 via the second switch S2. To the cathode electrode of the EL element 14 there can be applied a reverse bias voltage of 15V. By this, it is possible to omit the use of a power source the voltage level of that is fairly higher than that of other power sources, such as VHbb=25 V that was explained in FIGS. 3 and 4.

Furthermore, in case where ensuring a potential difference of 15 V as each of the forward-directional voltage and reverse bias voltage, this can be achieved by preparing the power sources of 10 V and 5 V in terms of the absolute value. Thereby, it becomes possible to drive the display panel with a power source circuit the voltage level of that is again lower.

By the way, in case where relevant control is performed by utilizing the switches S1 and S2 and, thereby, supplying each of the positive and negative power sources, by changing it over, when performing forward-directional driving and applying a reverse bias voltage, the following point in problem arises. As a result, there occurs the phenomenon that, especially at the time when applying a reverse bias voltage, it becomes difficult to effectively apply a reverse bias voltage with respect to the EL element 14.

The above-described points in problem will be explained by taking up the circuit construction illustrated in FIG. 5 as an example. Namely, in the circuit construction illustrated in FIG. 5, that the VHanod and VLcath are set in the way of the VHanod=10 V and VLcath=−5 V is as described before. In case where a consideration is given of a gate voltage of the TFT 12 that is necessary for performing on/off control of the drive TFT 12 when supplying a forward-directional current to the EL element 14, since the TFT 12 is a P-channel, a potential of 10 V at minimum becomes necessary for turning off the TFT 12. Also, for turning on the TFT 12, the earth potential (=0 V) that is a reference potential point can be utilized as is. Accordingly, as the data signal that is supplied to the source of the control TFT 11, the VHdata and VLdata can be set to be the VHdata=10 V and the VLdata=0 V.

Incidentally, in case where the earth potential that is the reference potential point can be utilized as the gate voltage for turning on the TFT 12 as described above, this technique is adopted, for example, when adjusting the luminous luminance of the EL element with the VHanod voltage and thereby performing digital gradation the gradation method of that is time gradation, etc. For instance, in case where adjusting the luminous luminance with a VLcont voltage and thereby performing digital gradation, or in case where performing analog gradation, an intermediate value between 0 V and 10 V is used as the gate voltage of the TFT 12. Accordingly, in the description that follows, an explanation will be given on the premise of a case where there is adopted the former construction of adjusting the luminance of the EL element with the VHanod and thereby performing digital gradation the gradation method of that is time gradation, etc.

Here, since the control TFT 11 is an N-channel as described before, in order to selectively supply the VHdata and VLdata signal to the gate of the drive TFT, it becomes necessary that a control voltage (VHcont) of 12 V prepared by adding a threshold voltage of at least 2 V to the VHdata=10 V be supplied to the gate of the control TFT 11. Also, during a non-scan period, the earth potential (=0 V) that is the reference potential point can be utilized as is with respect to the gate of the control TFT 11 to thereby enable turning off the control TFT 11. Accordingly, as the control line signal voltage that is supplied to the gate of the control TFT 11, preferably, it is set to be the VHcont=12 V and VLcont=0 V.

Here, at the time when changing over the applied state of the EL element 14 from a state where a forward-directional voltage is being applied to the EL element 14 to a state where a reverse bias voltage is applied thereto, a resetting operation of electrically discharging the electric charge of the capacitor 13 is executed. Namely, in a state where a forward-directional voltage is applied, a voltage of VHanod=10 V is being applied to one terminal (a) of the capacitor 13. Therefore, when supplying a voltage of VHcont=12 V to the control line and, at this time, supplying a voltage of VHdata=10 V to the data line, a voltage of 10 V (VHdata) is applied to the other terminal (b) of the capacitor 13. Accordingly, at that moment, the voltages at the both terminals of the capacitor 13 become equal in potential, whereby the electric charge is discharged (reset). Thereafter, a voltage of the VLcont=0 V is supplied, thereby the control TFT 11 is turned off.

Subsequently, the changeover switches S1 and S2 illustrated in FIG. 5 are each changed over to a direction opposite to that illustrated therein. And, a voltage of VLcath=−5 V is supplied to the source of the drive TFT 12 while a voltage of VHanod=10 V is supplied to the cathode of the EL element 14. At this moment, −5 V is led into the terminal (b) via the capacitor 13 the charge of that is in a state of being electrically discharged. At this moment, −5 V is also led into the drain, as well, of the control TFT 11, whereby the drain of the control TFT 11 the voltage of that has been sufficiently made low as compared with the gate voltage thereof substantially functions as the source. Therefore, since the control TFT 11 is an N-channel, it becomes instantaneously turned on because of the relationship biased as described before. Therefore, via the control TFT 11, the gate potential of the drive TFT 12 is raised from −5 V and, in extreme cases, sometimes, is raised up to a level of around +10V.

Also, in the drive TFT 12, because of the above-described changeover of the changeover switches S1 and S2, the source and the drain have their functions inverted. Thereby, a gate voltage that is approximate to the source potential (VHanod=10V) attained by the function being inverted is applied to the gate of the drive TFT 12. As a result of this, the drive TFT 12 is brought to a state of its being turned off. As a result of this, it becomes impossible to effectively apply a reverse bias voltage to the EL element 14. Therefore, the problem remains that the effect of extending the service life of the EL element becomes halved.

On the other hand, the applicant of this application applied, as Japanese Patent Application No. 2002-230072, for a patent on a circuit construction wherein a diode is connected in parallel to the drive TFT; and, by utilizing the action of the diode that becomes electrically conductive when applying a reverse bias voltage, a reverse bias voltage is effectively applied to the EL element 14. FIG. 7 illustrates a circuit construction wherein the diode 18 is added to the circuit construction illustrated in FIG. 6. According to the construction illustrated in FIG. 7, in case where the switches S1 and S2 have each been changed over to a state opposite to that which is illustrated and a reverse bias voltage has been applied to the EL element 14, the diode 18 becomes electrically conductive. By this, it is possible to effectively apply a reverse bias voltage to the EL element 14.

However, according to the circuit construction illustrated in FIG. 7, in a state where a reverse bias voltage is being applied to the EL element 14, because the TFT 21 and TFT 11 are each an N channel, each of them is turned on. Resultantly, there arises the inconvenience that short-circuiting between the VLcath and the VHdata or VLdata occurs.

SUMMARY OF THE INVENTION

The present invention has been made in conceit of the above-described several technical points in problem and has an object to provide a device for driving a luminescent display panel, in which, in a luminescent display panel that has been constructed so that a reverse bias voltage may sequentially be supplied to the EL element, a reverse bias voltage can effectively be applied to the EL element via a drive TFT. In addition, the present invention has another object to provide a device for driving a luminescent display panel which can light-up drive by having supplied thereto a voltage level, that is relatively lower than a relevant power source circuit. Furthermore, the present invention has still another object to provide a device for driving a luminescent display panel, in which, in the circuit construction that has been exemplified in the foregoing description, it is possible to prevent the occurrence of an inconvenience that the above-described short-circuited state is brought about.

A driving device according to the present invention that has been invented for attaining the above object is, as described in claim 1, a device for driving a luminescent display panel, which includes a luminescent element, a drive TFT for light-up driving the luminescent element, a control TFT for controlling the gate voltage of the drive TFT, and a power source circuit that, for causing the luminescent element to continue to perform its luminescing operation, can supply a forward-directional electric current to the luminescent element and apply a reverse bias voltage that is reverse to the forward-directional current voltage to the luminescent element, wherein the power source circuit is the one that outputs a power source voltage level the potential of that is positive or negative with respect to the reference potential, and the power source circuit is arranged so that, in a state of supplying a forward-directional electric current to the luminescent element, it may supply a power source voltage level of positive potential to one terminal functioning as the anode of the luminescent element and supply a power source voltage level of negative potential to the other terminal functioning as the cathode of the luminescent element; and so that, in a state of applying a reverse bias voltage to the luminescent element, it may supply a power source voltage level of negative potential to the one terminal functioning as the anode of the luminescent element and supply a power source voltage level of positive potential to the other terminal functioning as the cathode of the luminescent element; and at least the drive TFT and control TFT are each constructed using the same channel TFT.

DESCRIPTION OF THE PREFERRED EMBODIMENTS

Figure 1:
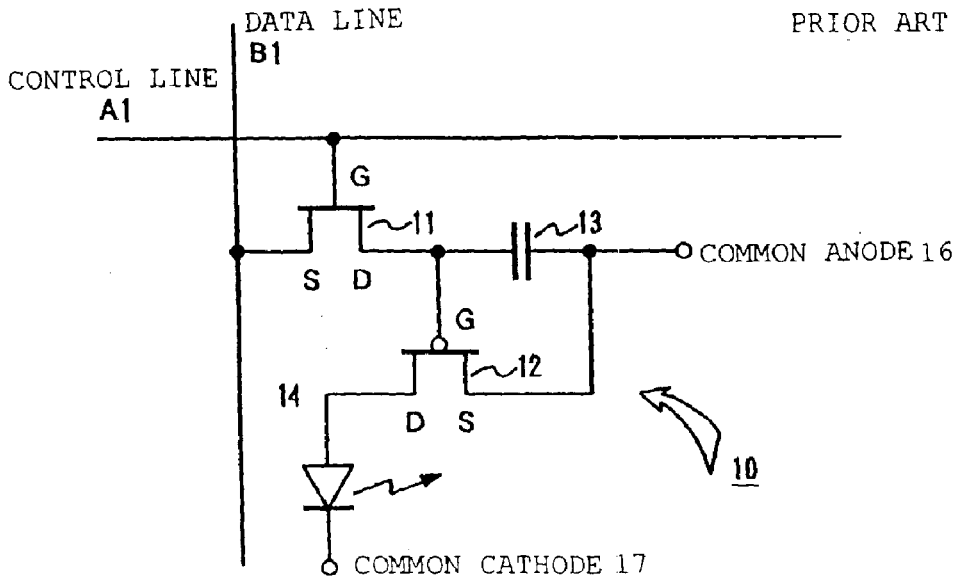
FIG. 1 is a line connection diagram illustrating an example of a circuit construction corresponding to one pixel in a conventional active matrix type display panel.
Figure 2:
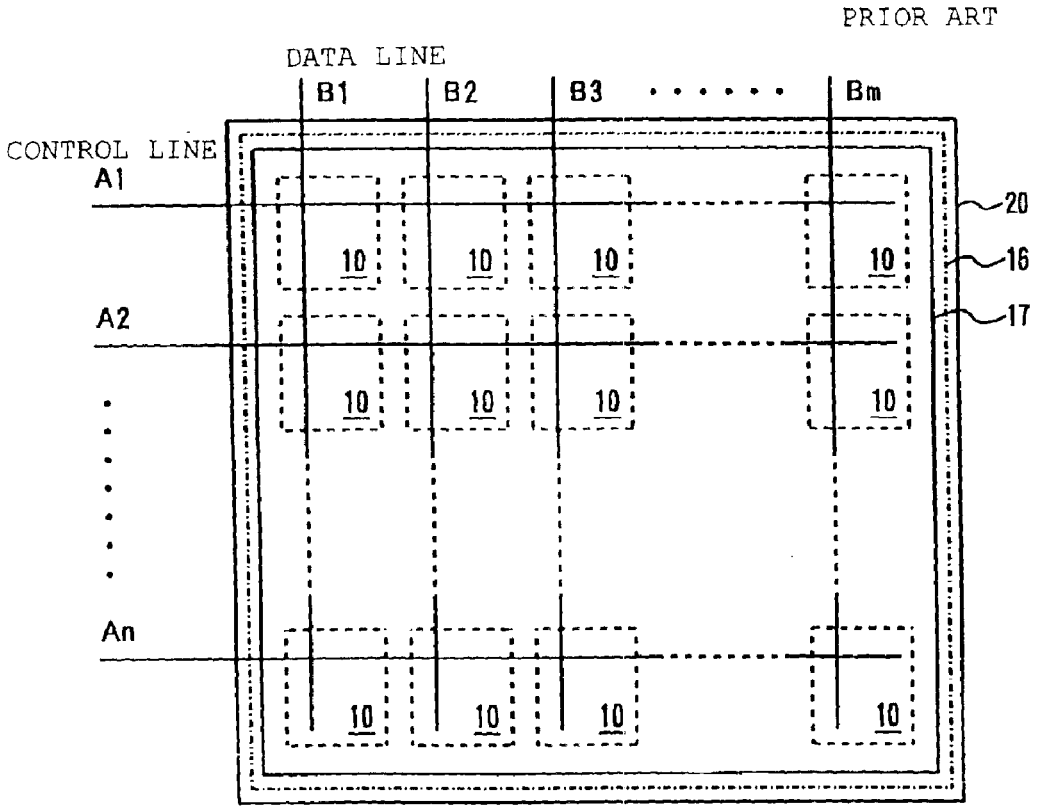
FIG. 2 is a plan view typically illustrating a state where the circuit construction of a respective one of the pixels illustrated in FIG. 1 is arrayed in the display panel.
Figure 3:
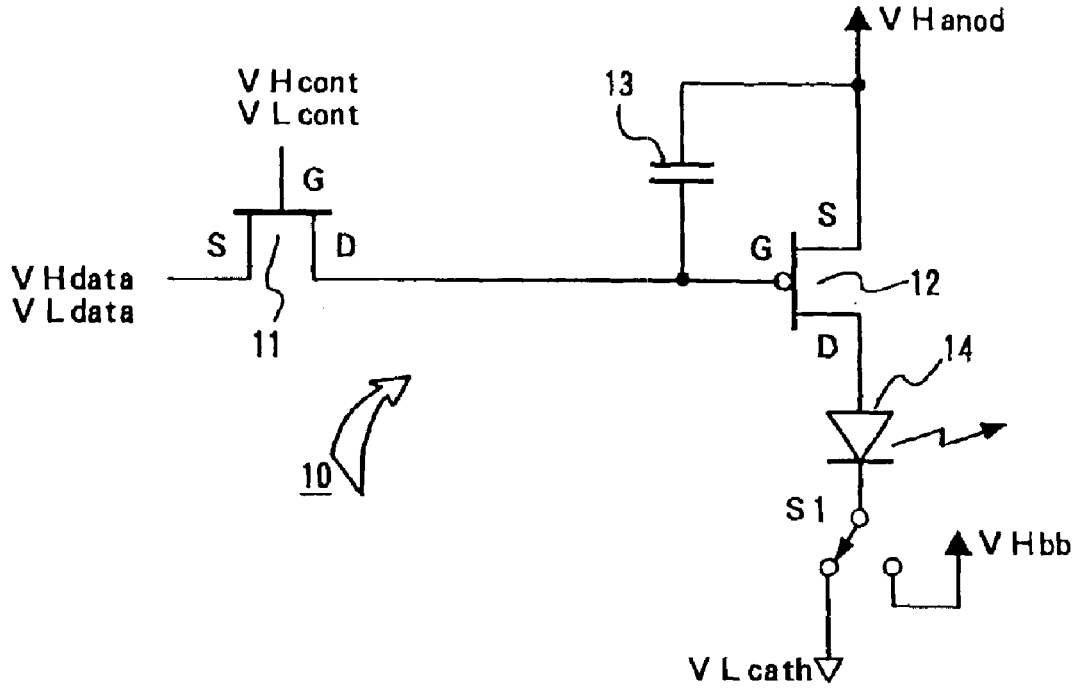
FIG. 3 is a line connection diagram per pixel illustrating a first circuit construction that, in case where applying a reverse bias voltage to the luminescent element, is thought available.
Figure 4:
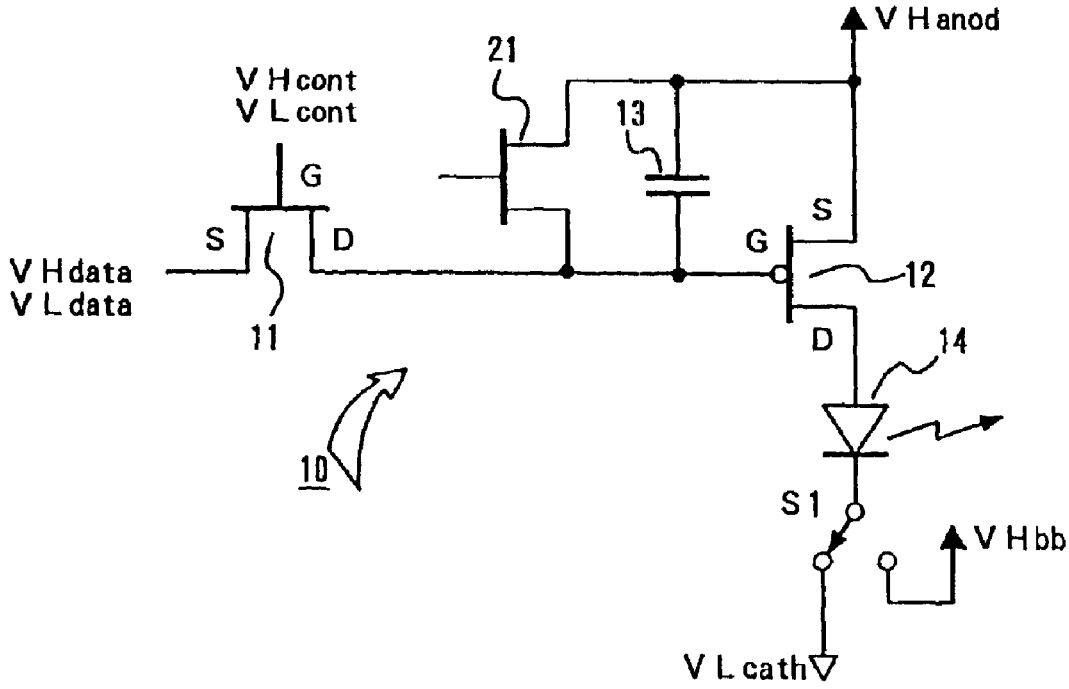
FIG. 4 is a line connection diagram per pixel illustrating a second circuit construction that is so thought.

Hereinafter, a device for driving a luminescent display panel according to the present invention will be explained on the basis of the embodiments illustrated in the drawings. Incidentally, in the following explanation, the portions (elements) that correspond to the respective portions (elements) illustrated in the respective figures that were already explained are denoted by the same reference symbols and, therefore, the individual functions and operations of them have their explanation suitably omitted.

Figure 5:
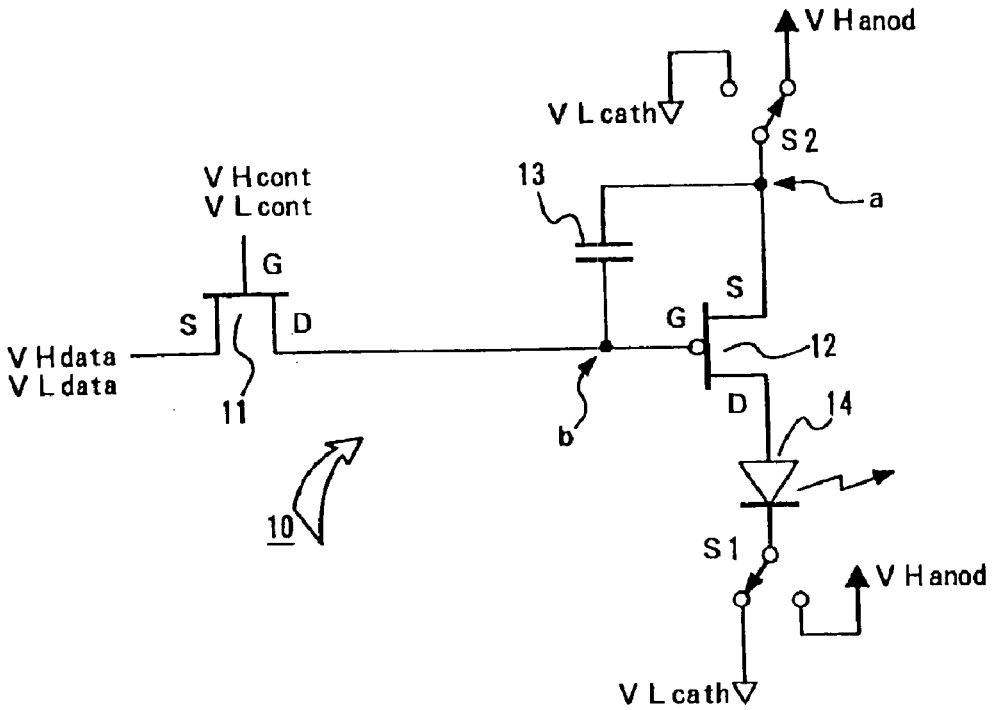
FIG. 5 is a line connection diagram per pixel illustrating a third circuit construction that is so thought.
Figure 8:
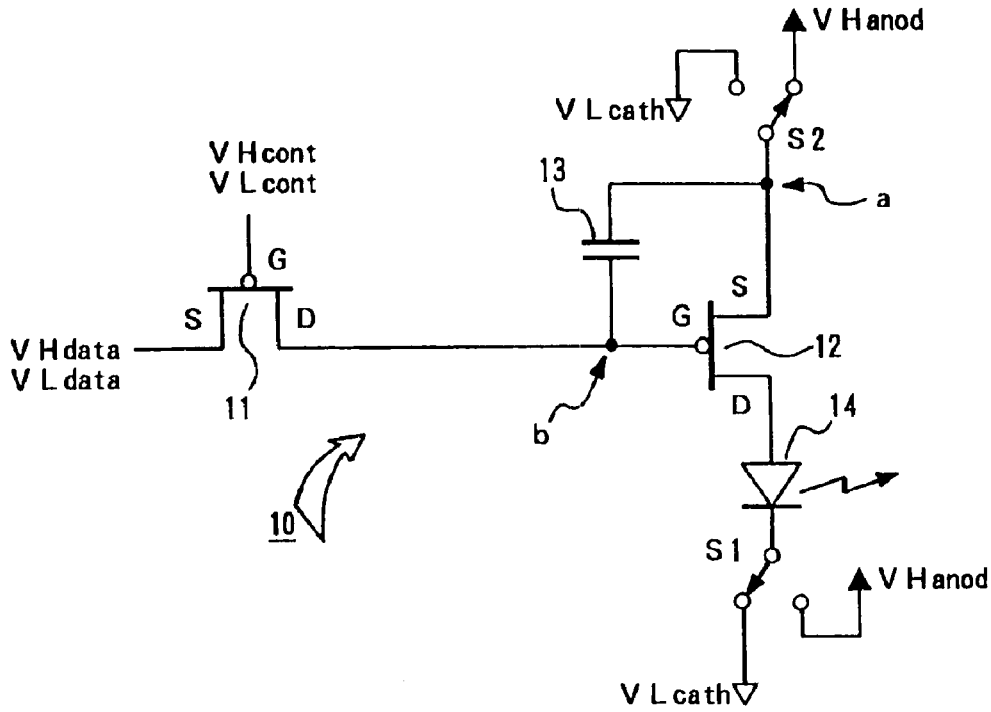
FIG. 8 is a line connection diagram per pixel illustrating a first embodiment of the present invention.

FIG. 8 illustrates a first embodiment of the present invention and illustrates a circuit construction corresponding to one pixel 10. In this first embodiment, there is utilized drive means for performing driving with the use of the conductance control method that was already explained. When comparing it with the construction illustrated in FIG. 5, it uses a P channel as the control TFT 11. Namely, in this embodiment, as the drive TFT 12 and control TFT 11, a P channel type TFT is used for each of them. And, in the embodiment, as well, illustrated in FIG. 8, a relevant construction is made so that a power source voltage of VHanod=10 V and VLcath=−5 V may be utilized.

And, in case where causing a forward-directional electric current to flow into the EL element 14, the first switch S1, as illustrated, selects the power source voltage level (VLcath=−5 V) of negative potential. The second switch S2, as illustrated, selects the power source voltage level (VHanod=10 V) of positive potential. In case where applying a reverse bias voltage to the EL element 14, the first switch S1 is changed over to the opposite direction to that illustrated and thereby selects the power source voltage level (VHanod=10 V) of positive potential. The second switch S2 is changed over to the opposite direction to that illustrated and thereby selects the power source voltage level (VLcath=−5 V) of negative potential.

On the other hand, in case where a thought is given of the gate voltage of the TFT 12 that is necessary for performing "on"/"off" control of the drive TFT 12, since the drive TFT 12 is a P-channel type, to bring it to an "off" state a potential of 10 V at minimum becomes necessary. Also, for turning on the TFT 12, the earth potential (=0 V) that is the reference potential point can be utilized as is. Accordingly, as the data signal voltage supplied to the source of the control TFT 11, preferably, setting of the VHdata and VLdata is done in the way of the VHdata=10 V and the VLdata=0 V. This is the same as the example illustrated in FIG. 5.

On the other hand, the control TFT 11 according to this embodiment is a P channel type as described above. Therefore, for selectively supplying the VHdata=10 V and VLdata=0 V to the gate of the drive TFT, it is possible to utilize a combination of the VHcont=10 V and VLcont=−5 V as the gate voltage of the control TFT 11. The voltage levels used as the VHanod and VLcath can be utilized, as are, for those voltage levels.

As a result of this, the control TFT 11 can be turned off with a combination of the VHdata=10 V and the VHcont=10 V and can be turned on with a combination of the VHdata=10 V and the VLcont=−5. Further, the control TFT 11 can be turned off with a combination of the VLdata=0 V and the VHcont=10 V and can be turned on with a combination of the VLdata=0 V and the VLcont=−5V.

Here, when changing over from a state where a forward-directional voltage is being applied to the EL element 14 to a state where a reverse bias voltage is applied, the resetting operation of electrically discharging the electric charge of the capacitor 13 is executed in the same way as stated before. This is because, by controlling the drive TFT 12 to an "on" state when having applied a reverse bias voltage to the EL element 14, one aims to enhance the effect of applying a reverse bias voltage to the EL element 14.

And, in a state where a forward-directional voltage has been applied to the EL element 14, a voltage of the VHanod=10 V is applied to one terminal (a) of the capacitor 13. Therefore, when supplying a voltage of VLcont=−5 to the control line and, at this time, supplying a voltage of VHdata=10 V to the data line, a voltage of 10 V (=VHdata) is applied to the other terminal (b) via the control TFT 11. Accordingly, at this moment, the voltages at the both terminals of the capacitor 13 are made the same in potential, whereby the electric charge is electrically discharged (reset). After that, a voltage of VHcont=10 V is supplied to thereby turn off the control TFT 11.

Subsequently, each of the changeover switches S1 and S2 illustrated in FIG. 8 is changed over to the opposite direction to that illustrated; a voltage of VLcath=−5 V is supplied to the source of the drive TFT 12; and a voltage of VHanod=10 V is supplied to the cathode of the EL element 14. At this moment, the terminal (b) is led into a voltage of −5 V via the capacitor 13 that is kept in a state where the electric charge is discharged. Although, at this time, the drain of the control TFT 11 is also led into a voltage of −5V, since the control TFT 11 is of a p-channel type, the state of the control TFT 11 being cut off is maintained.

As a result of this, to the gate of the drive TFT 12 there is reliably applied the above-described voltage of −5V, whereby the drive TFT 12 is brought to an "on" state. Accordingly, to the EL element 14, there is effectively applied via the drive TFT 12 a reverse bias voltage, whereby extending the service life of the EL element becomes possible.

Incidentally, although in the foregoing explanation the VLcont is made −5 V that is the same voltage as that of the VLcath, a voltage of −2 V is prepared as the power source, though not illustrated, for each driver part. Accordingly as the VLcont, is also possible to utilize that power source voltage of −2V.

According to the embodiment illustrated in FIG. 8 that has been explained above, when applying a reverse bias voltage to the EL element, it is possible to turn on the drive TFT 12. Therefore, it is possible to effectively apply a reverse bias voltage to the EL element 14 via the drive TFT and also to extend the service life of the element. Also, supplying a forward-directional current and a reverse bias voltage to the EL element can be realized by a combination of the power source voltages whose absolute values are small.

Figure 6:
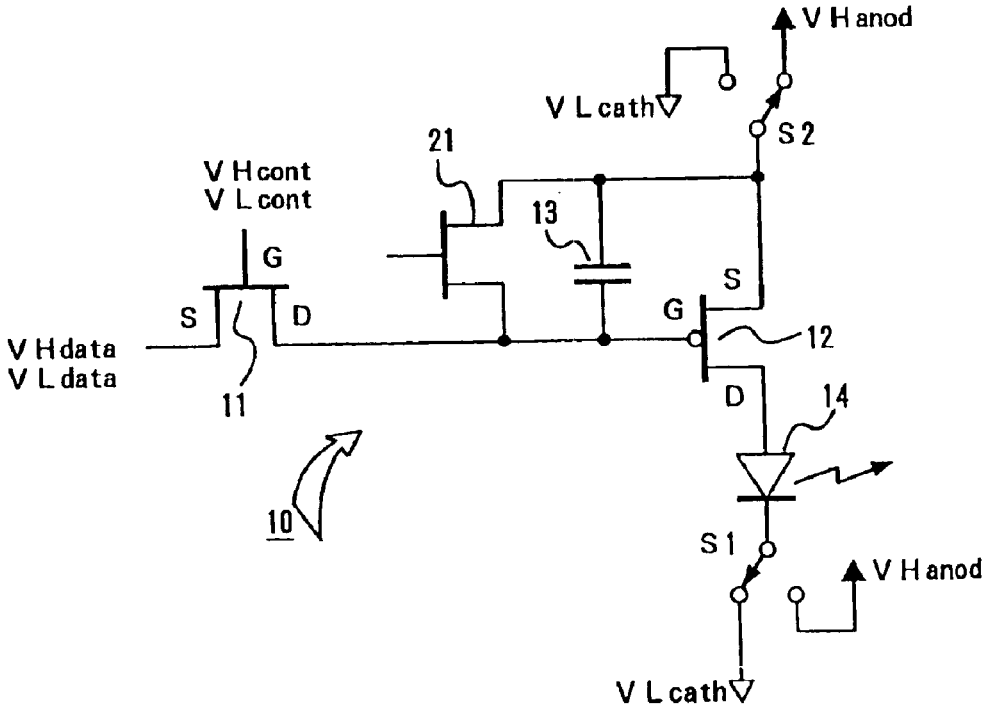
FIG. 6 is a line connection diagram per pixel illustrating a fourth circuit construction that is so thought.
Figure 9:
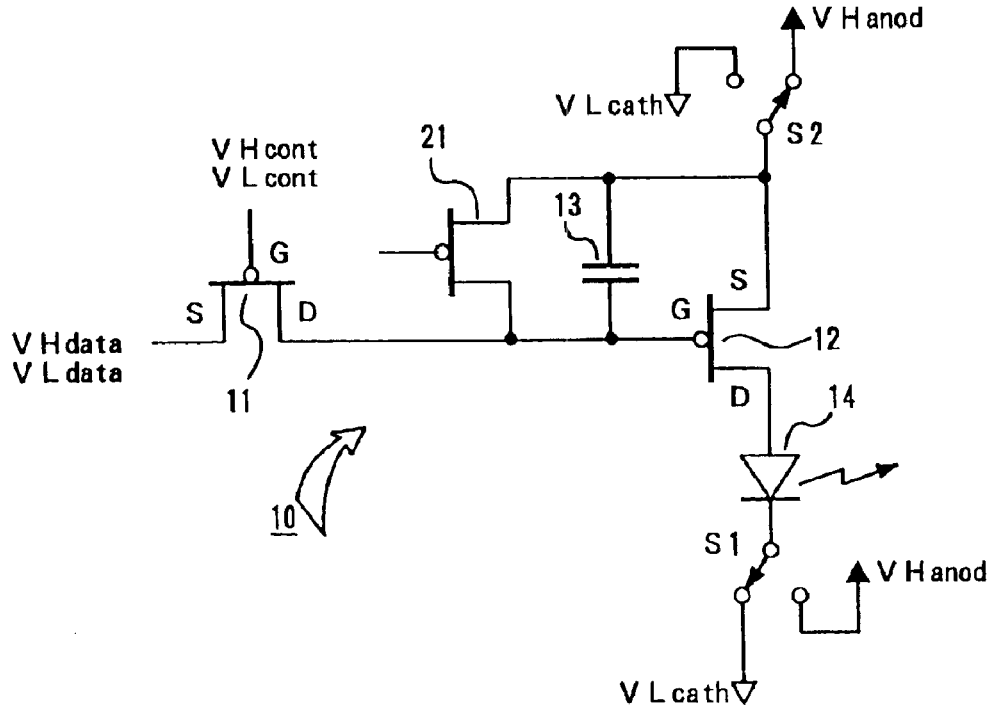
FIG. 9 is a line connection diagram per pixel illustrating a second embodiment of the present invention.

Next, FIG. 9 illustrates by a circuit construction corresponding to one pixel 10 of a second embodiment of the present invention. In the construction, as well, illustrated in FIG. 9, as in the case of the construction illustrated in FIG. 6 which was already explained, there is also utilized the drive means, based on the use of the 3-TFT method, which realizes digital-gradation driving. Comparing it with the construction illustrated in FIG. 6, a P channel type is used as the control TFT 11. Namely, in this embodiment as well, as the drive TFT 12 and control TFT 11, a P-channel type TFT is used for each of them. Further, for an erasing TFT 21 for performing gradation expression, also, a P channel type TFT is used.

According to this construction, the operational relationship between the drive TFT 12 and the control TFT 11 is the same as in the case of the construction illustrated in FIG. 8. Namely, to the EL element 14 there can be effectively applied via the drive TFT 12 a reverse bias voltage in this state where a reverse bias voltage is applied, by applying, for example, the reference potential (0 V) to the gate of the erasing TFT 21, the "cut-off" state can be maintained. Therefore, no bad effect occurs on the "on" state of the drive TFT 12.

Also, the erasing TFT 21, by applying a power source voltage of, for example, 10 V to the gate thereof within a period in which a forward-directional electric current is flowing into the EL element 14 and it therefore is able to luminesce, can be brought to a "cut-off" state. And, by applying the reference potential (0 V) to the gate of the erasing TFT 21 during a period in which the EL element is able to luminesce, it is possible to cause the transistor to be turned on, thereby enabling it to perform an effective gradation control. Therefore, according to the construction illustrated in FIG. 9, it is possible to execute the light-up operation of lighting up the EL element and the applying operation of effectively applying a reverse bias voltage without newly providing a special power source (voltage).

In this embodiment, as well, illustrated in FIG. 9, when applying a reverse bias voltage to the EL element, it is possible to bring the drive TFT 12 to an "on" state. Therefore, it is possible to effectively apply a reverse bias voltage to the EL element via the drive TFT and thereby to extend the service life of the element. In addition, it is possible to realize supplying a forward-directional current and supplying a reverse bias voltage to the EL element 14 by a combination of the power source voltages whose absolute values are small. In addition in the embodiment illustrated in FIG. 9 as each of the control TFT 11, drive TFT 12, and erasing TFT 21 a P-channel type TFT is utilized, applying the existing 10 V or the reference potential point "0 V" as the gate voltage of the erasing TFT 21 enables effectively performing gradation control.

Figure 10:
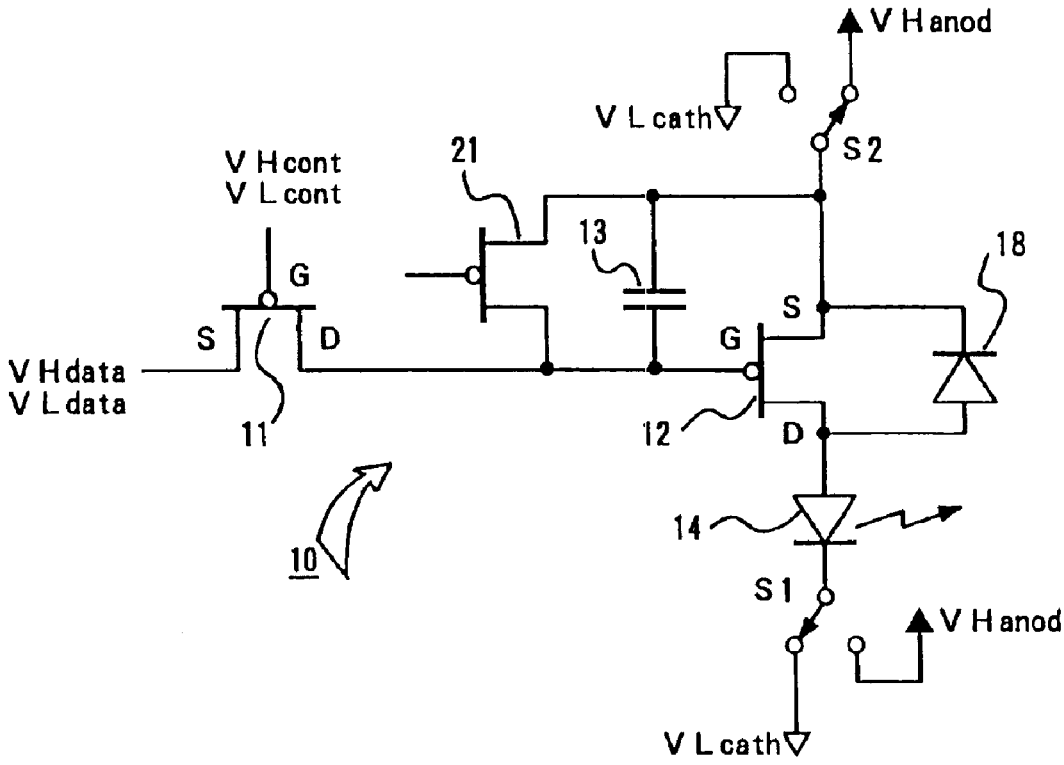
FIG. 10 is a line connection diagram per pixel illustrating a third embodiment of the present invention.

FIG. 10 illustrates by a circuit construction corresponding to one pixel 10 of a third embodiment of the present invention. The construction illustrated in FIG. 10 is formed into a type wherein, in addition to the construction illustrated in FIG. 9, there is equipped a diode 18 that is connected in parallel to the drive TFT 12 and, when applied with a reverse bias voltage, becomes electrically conductive. In this construction as well, when applying a reverse bias voltage to the EL element 14, the changeover switches S1 and S2 are each changed over to the opposite state to that illustrated. The diode 18 that has been connected in parallel to the drive TFT 12 becomes electrically conductive and this enables effectively applying a reverse bias voltage to the EL element 14.

Figure 7:
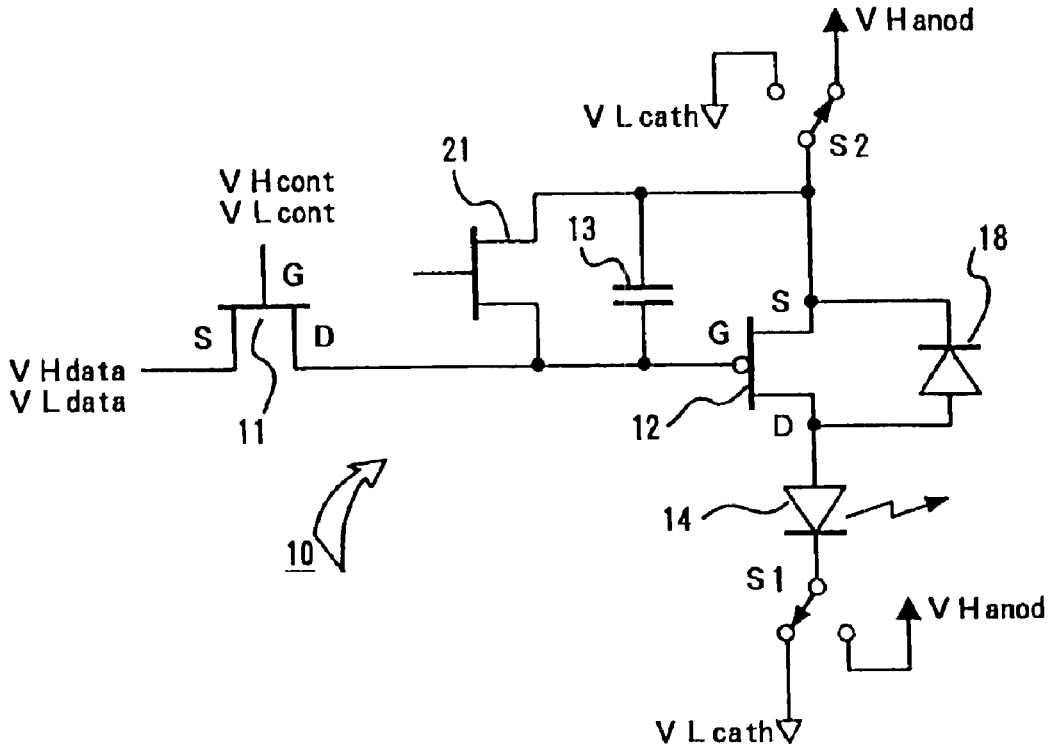
FIG. 7 is a line connection diagram per pixel illustrating a fifth circuit construction that is so thought.

And, in a state where the EL element 14 is applied with a reverse bias voltage, since each of the TFT 21 and TFT 11 is constructed using a P channel type transistor, it is maintained in an "off" state. Accordingly, as was explained in FIG. 7, it is possible to effectively avoid the occurrence of an inconvenience that the VLcath and the VHdata or VLdata is short-circuited. Incidentally, although in the embodiment illustrated in FIG. 10 the diode 18 is connected in parallel made using, for example a TFT which, when a reverse bias voltage is applied, is controlled to an "on" state may be disposed.

In this embodiment, as well, illustrated in FIG. 10, it is possible to similarly effectively apply a reverse bias voltage to the EL element and, thereby, to achieve the extension of the service life of the element. In addition, it is possible to similarly realize supplying a forward-directional current and supplying a reverse bias voltage to the EL element 14 by a combination of the power source voltages whose absolute values are small. Further, according to the embodiment illustrated in FIG. 10, because a P channel type TFT is utilized as the control TFT 11, drive TFT 12, and erasing TFT 21, in a state where a reverse bias voltage is applied, it is possible to effectively avoid the occurrence of an inconvenience that the VLcath and the VHdata or VLdata becomes short-circuited.

Figure 11:
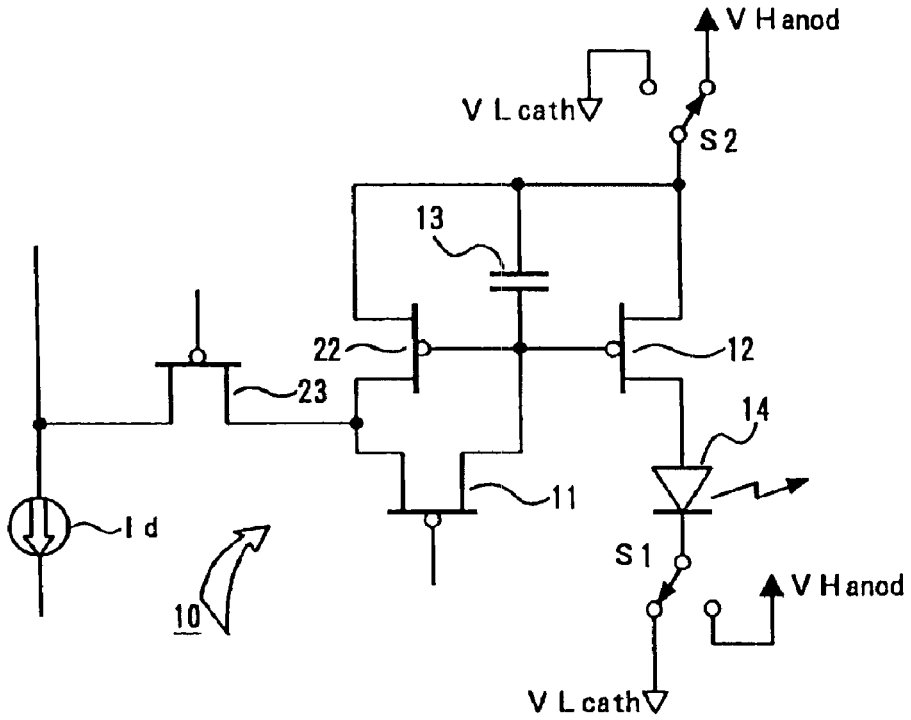
FIG. 11 is a line connection diagram per pixel illustrating a fourth embodiment of the present invention.

FIG. 11 illustrates a fourth embodiment of the present invention by a circuit construction corresponding to one pixel 10. This construction illustrated in FIG. 11 utilizes drive means for driving with the use of a so-called "current mirror" method. The construction is made so that the writing processing into the capacitor for holding electric charge as well as the light-up driving operation may be performed through the performance of the current mirror operation. In this construction illustrated in FIG. 11, also, a power source voltage of VHanod=10 V and a power source voltage of VHcath=−5 V may be utilized. Namely, in case where causing a forward-directional electric current to flow into the EL element 14 and in case where applying a reverse bias voltage to the EL element 14, it is arranged that each of the VHanod=10 V and the VLcath=−5 V be used by having its output level inverted in terms of the polarity via the changeover switch S1 or S2.

Also, a TFT 22 that is of a P-channel type is symmetrically equipped in the way that the gate of it is commonly connected to the P-channel type drive TFT 12. Between the gate and source of each of the both TFTs 12 and 22 there is connected a capacitor 13 for holding an electric charge. Also, between the gate and drain of the TFT 22 there is connected the control TFT 11 that is similarly of a P-channel type. By this control TFT 11 being turned on, the TFTs 12 and 22 function as a current mirror. Namely, it is arranged that, as the control TFT 11 is turned on, a switching TFT 23 that is constructed using a P-channel type transistor be also turned on. Thereby, a writing current source Id is connected to the current mirror circuit via the switching TFT 23.

As a result of this, during an addressing period, there is formed an electric-current path the electric current of that flows from the power source of VH anod=10V to the writing current source Id via the switch S2, TFT 22, and TFT 23. Also, due to the action of the current mirror circuit, an electric current that corresponds to the electric current flowing into the current source Id is supplied to the EL element 14 via the drive TFT 12. As a result of the above-described operation, into the capacitor 13 there is written the gate voltage of the TFT 22 into the writing current source Id. And, after a prescribed voltage value has been written into the capacitor 13, the control TFT 11 is turned off, whereby the drive TFT 12 acts to supply a prescribed electric current to the EL element 14 according to the electric charge that has been accumulated in the capacitor 13. It thereby performs its light-up driving operation.

On the other hand, at the applying timing of applying a reverse bias voltage, the changeover switches S1 and S2 are each changed over to the opposite state to that illustrated. Thereby, to the source of the drive TFT 12 there is supplied a voltage of VLcath=−5V, while, on the other hand, to the cathode of the EL element 14 there is supplied a voltage of VHanod=10V. At that moment, to the gate of the drive TFT 12 there is applied a voltage that has been obtained by a voltage of VLcath=−5 V being further superimposed on the electric charge already accumulated in the capacitor 13.

The voltage level that is applied at this time to the gate of the drive TFT 12 is made a voltage that has been further shifted to the minus direction from the VLcath (=−5 V). Thereby, the drive TFT 12 is turned on because of its being of a P-channel type. And, to the EL element 14, there is effectively applied via the drive TFT 12 a reverse bias voltage. Also, the control TFT 11 is maintained in a "cut-off" state because of its being of a P-channel type. Incidentally, although, here, an explanation has been given of a case where the resetting operation of electrically discharging the electric charge of the capacitor 13 is not executed, even when the resetting operation is executed, the function and effect are the same.

According to the embodiment illustrated in FIG. 11 that has been explained above, when applying a reverse bias voltage to the EL element, it is possible to turn on the drive TFT 12. Therefore, it is possible to effectively apply a reverse bias voltage to the EL element 14 via the drive TFT and also to extend the service life of the element. Also, supplying a forward-directional current and a reverse bias voltage to the EL element can be realized by a combination of the power source voltages whose absolute values are small.

Figure 12:
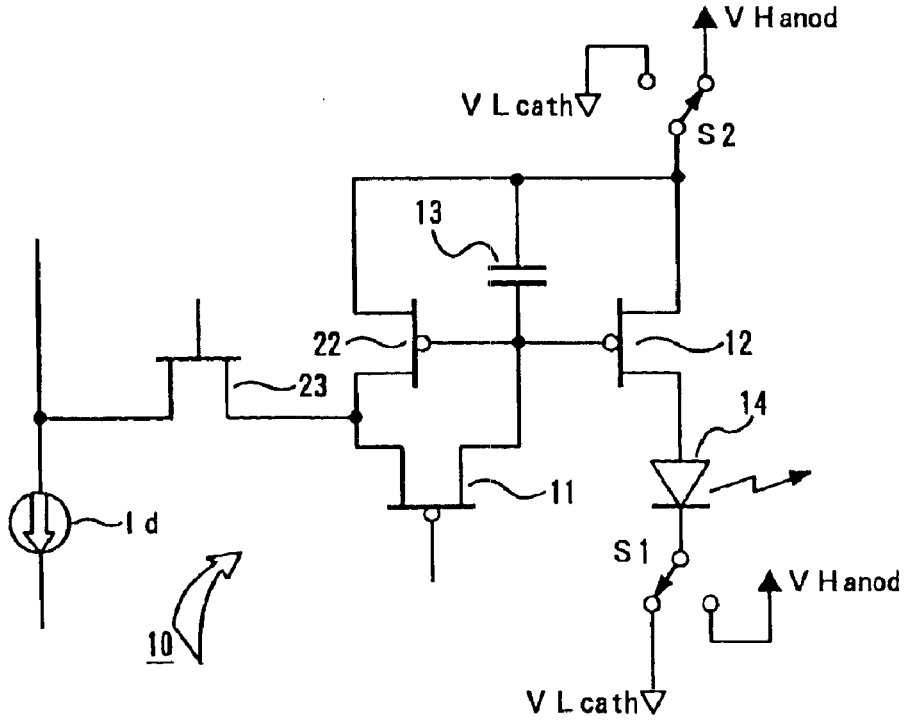
FIG. 12 is a line connection diagram per pixel illustrating a fifth embodiment of the present invention.

FIG. 12 illustrates by a circuit construction corresponding to one pixel 10 a fifth embodiment of the present invention. In the construction, as well, illustrated in FIG. 12, as in the case of the example explained in FIG. 11, there is adopted the current mirror technique. And, the differing point from the example explained in FIG. 11 resides in that the switching TFT 23 is constructed using an N-channel type transistor. In this construction as well, each of the drive TFT 12 and control TFT 11 is constructed using a P-channel type, the function and effect are the same as those in the example illustrated in FIG. 11.

Figure 13:
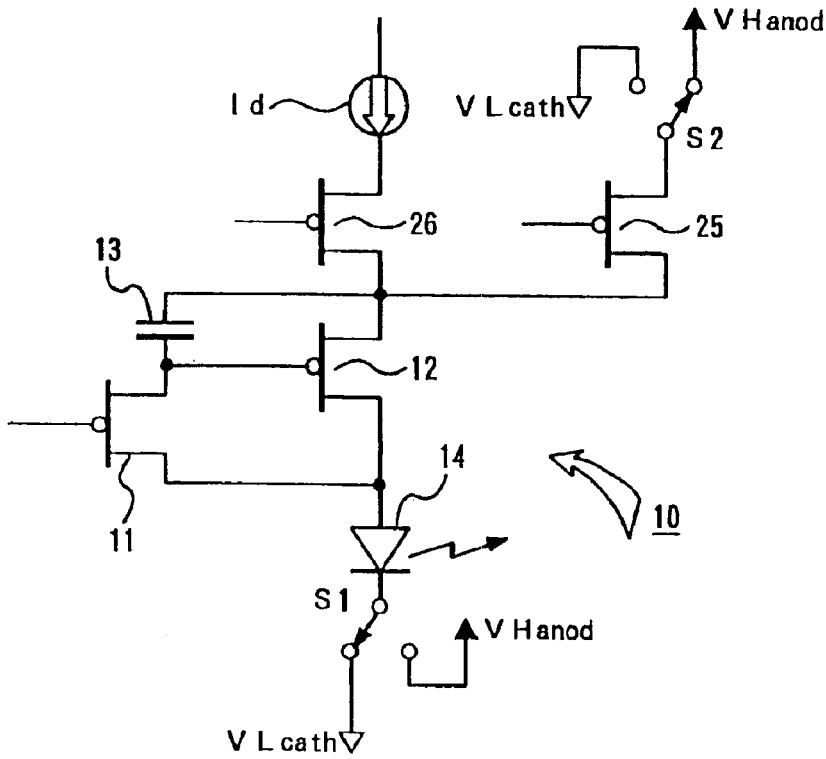
FIG. 13 is a line connection diagram per pixel illustrating a sixth embodiment of the present invention.

FIG. 13 illustrates a sixth embodiment of the present invention by a circuit construction corresponding to one pixel 10. This embodiment illustrates an example wherein this invention is adopted with respect to the current-programming technique. In this construction illustrated in FIG. 13, also, a power source voltage of Vanod=10 V and a power source voltage of VLcath=−5 V are utilized. Namely, in case where causing a forward-directional electric current to flow into the EL element 14 and in case where applying a reverse bias voltage to the EL element 14, it is arranged that each of the VHanod=10 V and the VLcath=−5 V be used by having its output voltage level inverted in terms of the polarity, via the changeover switch S1 or S2.

And, the circuit construction of FIG. 13 is made in the way that a serial circuit consisting of a switching TFT 25, driving P-channel type TFT 12, and EL element 14 is inserted between the changeover switches. Also, between the source and the gate of the drive TFT 12, there is connected the charge-holding capacitor 13 and, between the gate and the drain of the drive TFT 12 there is connected the control TFT 11 that is of a P-channel type. Further, to the source of the drive TFT 12, there is connected via the switching TFT 26 the writing current source Id.

In the construction illustrated in FIG. 13, a control signal is supplied to the gate of each of the control TFT 11 and switching TFT 25, which are both turned on. As a result of this, the drive TFT 12 is turned on, and, through the drive TFT 12, the electric current from the writing current source Id flows. At this time, a voltage that corresponds to the electric current from the writing current source Id is held in the capacitor 13.

On the other hand, at the time when the EL element makes its luminescing operation, the control TFT 11 and switching TFT 26 are both turned off, and the switching TFT 25 is turned on. By this, to the source side of the drive TFT 12, there is applied via the switch S2 a voltage of VHanod=10V, and to the cathode of the EL element 14, there is applied via the switch S1 a voltage of VLcath=−5V. The drain current of the drive TFT 12 is determined depending on the electric charge held in the capacitor 13, whereby the gradation control for the EL element is performed.

On the other hand, at the applying timing of applying a reverse bias voltage, the changeover switches S1 and S2 are each changed over to the opposite state to that illustrated. Thereby, to the source side of the drive TFT 12 there is supplied via the switching TFT 25 a voltage of VLcath=−5V, while, on the other hand, to the cathode of the EL element 14 there is supplied a voltage of VHanod=10V. At that moment, to the gate of the drive TFT 12 there is applied a voltage that has been obtained by a voltage's of VLcath=−5 V being further superimposed on the electric charge already accumulated in the capacitor 13.

The voltage level that is applied at this time to the gate of the drive TFT 12 is made a voltage that has been further shifted to the minus direction from the VLcath (=−5 V). Thereby, the drive TFT 12 is turned on because of its being of a P-channel type. And, to the EL element 14, there is effectively applied via the drive TFT 12 a reverse bias voltage. Also, the control TFT 11 is maintained in a "cut-off" state because of its being of a P-channel type. Incidentally, although, here, an explanation has been given of a case where the resetting operation of electrically discharging the electric charge of the capacitor 13 is not executed, even when the resetting operation is executed, the function and effect are the same.

According to this embodiment illustrated in FIG. 13 as well, when applying a reverse bias voltage to the EL element, it is possible to turn on the drive TFT 12. Therefore, it is possible to effectively apply a reverse bias voltage to the EL element via the drive TFT and also to extend the service life of the element. Also, supplying a forward-directional current and a reverse bias voltage to the EL element can be realized by a combination of the power source voltages whose absolute values are small.

Figure 14:
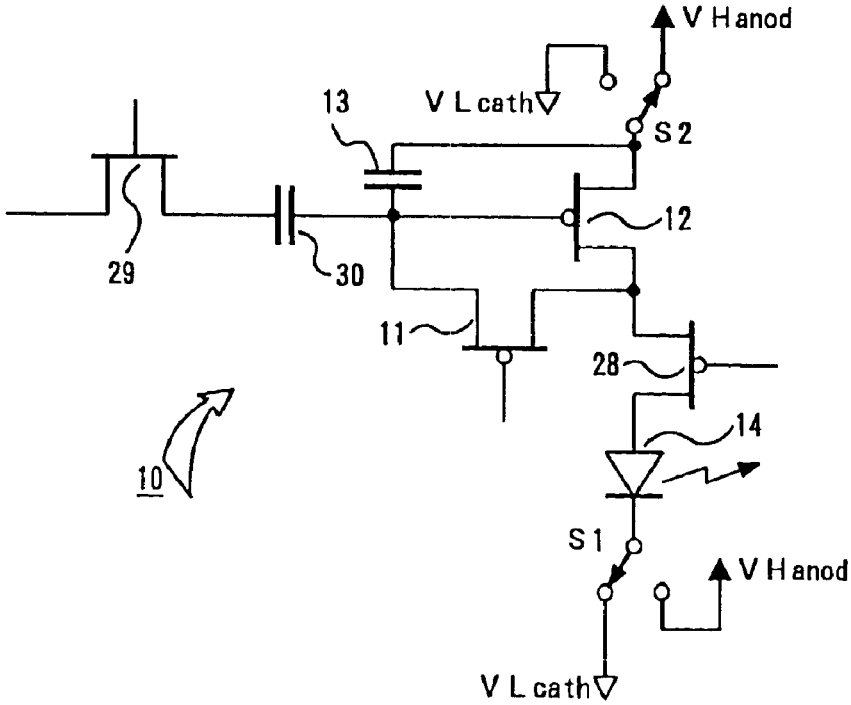
FIG. 14 is a line connection diagram per pixel illustrating a seventh embodiment of the present invention.

FIG. 14 illustrates a seventh embodiment of the present invention by a circuit construction corresponding to one pixel 10. This embodiment illustrates an example wherein this invention is adopted with respect to the voltage-programming technique. In this construction illustrated in FIG. 14, also, a power source voltage of VHanod=10 V and a power source voltage of VLcath=−5 V are utilized. Namely, in case where causing a forward-directional electric current to flow into the EL element 14 and in case where applying a reverse bias voltage to the EL element 14, it is arranged that each of the VHanod=10 V and the VLcath=−5 V be used by having its output voltage level inverted in terms of the polarity, via the changeover switch S1 or S2.

In this construction, to the drive TFT 12 there is connected in series a switching TFT 28, and, further, to this TFT 28 there is connected in series the ET element 14 Also, the capacitor 13 for holding electric charge is connected between the gate and the source of the drive TFT 12. Also, the control TFT 11 is connected between the gate and the drain of the drive TFT 12. In addition, in this voltage-programming technique, it is arranged that, to the gate of the drive TFT 12, there be supplied from the data line via a switching TFT 29 and capacitor 30 a data signal.

In the above-described voltage programming technique, the TFT 11 and TFT 28 are each turned on. Following this, the "on" state of the drive TFT 12 is ensured. And, by the TFT 28 being turned off at the next moment, the drain current of the drive TFT 12 is turned round into the gate of the drive TFT 12 via the control TFT 11. As a result of this, the between the gate and the source voltage of the drive TFT 12 is boosted until that voltage becomes equal to the threshold voltage of the TFT 12, and, at this time, the drive TFT 12 is turned off. And, the between gate/source voltage at that time is held in the capacitor 13, whereby the driving current of the EL element 14 is controlled by the capacitor voltage. Namely, in this voltage-programming technique, it plays the role of acting so as to compensate for the variation in the threshold voltage of the drive TFT 12.

In this construction, as well, illustrated in FIG. 14, at the applying timing of applying a reverse bias voltage, the change over switches S1 and S2 are each changed over to the opposite state to that illustrated. Thereby, to the source of the drive TFT 12 there is supplied a voltage of VLcath=−5V, while, on the other hand, to the cathode nf the EL element 14 there is supplied a voltage of VHanod=10V. At that moment, to the gate of the drive TFT 12 there is applied a voltage that has been obtained by a voltage of VLcath=−5 V being further superimposed on the electric charge already accumulated in the capacitor 13.

The voltage level that is applied at this time to the gate of the drive TFT 12 is made a voltage that has been further shifted to the minus direction from the VLcath (=−5 V). Thereby, the drive TFT 12 is turned on because of its being of a P-channel type. And, to the EL element 14, there is effectively applied via the drive TFT 12 a reverse bias voltage. Also, the control TFT 11 is maintained in a "cut-off" state because of its being of a P-channel type. Incidentally, although, here, an explanation has been given of a case where the resetting operation of electrically discharging the electric charge of the capacitor 13 is not executed, even when the resetting operation is executed, the function and effect are the same.

In the embodiment, as well, illustrated in FIG. 14, when applying a reverse bias voltage to the EL element, it is possible to turn on the drive TFT 12. Therefore, it is possible to effectively apply a reverse bias voltage to the EL element 14 via the drive TFT and also to extend the service life of the element. Also, supplying a forward-directional current and a reverse bias voltage to the EL element can be realized by a combination of the power source voltages whose absolute values are small.

Figure 15:
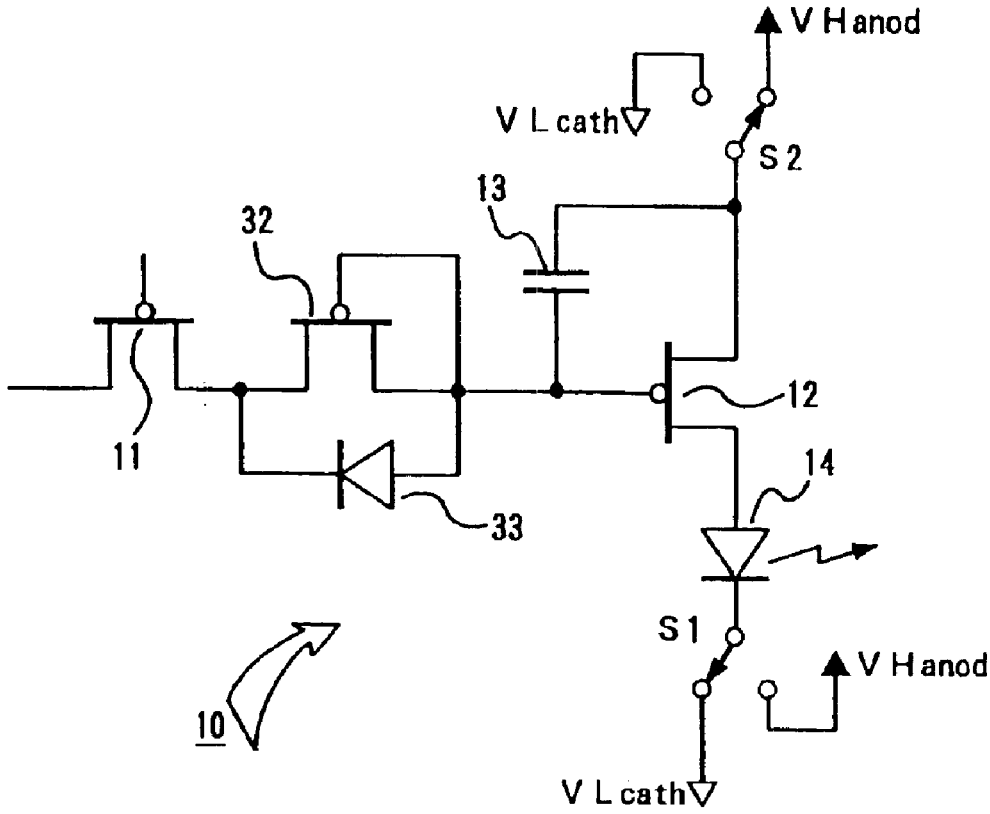
FIG. 15 is a line connection diagram per pixel illustrating an eighth embodiment of the present invention.

FIG. 15 illustrates an eighth embodiment of the present invention by a circuit construction corresponding to ore pixel 10. This embodiment illustrates an example wherein this invention is adopted with respect to the threshold voltage-compensating technique. In this construction illustrated in FIG. 15, also, a power source voltage of VHanod=10 V and a power source voltage of VLcath=−5 V are utilized. Namely, in case where causing a forward-directional electric current to flow into the EL element 14 and in case where applying a reverse bias voltage to the EL element 14, it is arranged that each of the VHanod=10 V and the VLcath=−5 V be used by having its output voltage level inverted in terms of the polarity, via the changeover switch S1 or S2.

In this construction, the EL element 14 is connected in series to the drive TFT 12 that is constructed using a P-channel type transistor, and, between the gate and the source of the drive TFT 12, there is connected the charge-holding capacitor 13. Namely, in this basic construction, it is the same as that illustrated in FIG. 8. On the other hand, in the construction illustrated in FIG. 15, between the drain of the control TFT 11 constructed using a P-channel type transistor and the gate of the drive TFT 12, there is inserted a parallel circuit that consists of a TFT 32 constructed using a P-channel type transistor and a diode 33. Incidentally, in the TFT 32, it is constructed in the way that a short-circuited state is established between the gate and the drain of it. Accordingly, the TFT 32 functions as an element for imparting a threshold characteristic from the control TFT 11 toward the gate of the drive TFT 12.

According to this construction, since the threshold characteristics of each TFT formed in one pixel are made very approximate to each other, it is possible to effectively cancel one threshold characteristic by another.

In this construction illustrated in FIG. 15, it is possible to perform the same operation as that corresponding to the function which was explained in FIG. 8. And, in case where a reverse bias voltage is supplied to the EL element 14 by changing over the switches S1 and S2, it is possible to turn on the drive TFT 12 via the capacitor 13 and hence to effectively apply a reverse bias voltage to the EL element 14 via the drive TFT 12.

In this embodiment, as well, illustrated in FIG. 15, when applying a reverse bias voltage to the EL element, it is possible, similarly, to turn on the drive TFT 12. Therefore, it is possible to effectively apply a reverse bias voltage to the EL element 14 via the drive TFT and also to extend the service life of the element. Also, supplying a forward-directional current and a reverse bias voltage to the EL element 14 can be realized by a combination of the power source voltages whose absolute values are small.

Incidentally, in each of the respective embodiments of the present invention that have been explained as above, illustration is made of an example wherein a P-channel type transistor is used as either transistor of the drive TFT and control TFT. However, even when using an N-channel type TFT as either transistor of them, it is possible to obtain the same function and effect.

Also, in each of the respective embodiments of the present invention that have been explained as above, both in case where supplying a forward-directional current to the EL element and in case where supplying a reverse bias voltage to it, it is attempted to utilize a combination of a power source voltage of positive potential (in the embodiment VHanod=10 V) and a power source voltage of negative potential (in the embodiment VLcath=−5 V). However, in case where supplying a forward-directional electric current to the EL element and in case where supplying a reverse bias voltage to the element, it is not always necessary to utilize the same potentials of voltages as the power source voltages of positive and negative in the way that they are combined. Even when different potential levels are combined as those power source voltages of positive and negative and are utilized, it is possible to obtain the same function and effect.

Furthermore, in each of the respective constructions that adopt the conductance control method illustrated in FIG. 8, the current mirror method illustrated in FIGS. 11 and 12, the current-programming method illustrated in FIG. 13, the voltage-programming method illustrated in FIG. 14, and the threshold voltage-correcting method illustrated in FIG. 15, also, as in the example illustrated in FIG. 10, it is possible to use a construction wherein the diode 18 that, in a state where a reverse bias voltage is being applied, becomes electrically conductive is connected in parallel to the drive TFT 12.

What is claimed is:

1. A device for driving a luminescent display panel comprising; a luminescent element, a drive TFT for light-up driving the luminescent element, a control TFT for controlling the gate voltage of the drive TFT, and a power source circuit that, for causing the luminescent element to perform its luminescing operation, can supply a forward-directional electric current to the luminescent element and apply a reverse bias voltage that is reverse to the forward-directional current voltage to the luminescent element, wherein the power source circuit is the one that outputs a power source voltage level the potential of that is positive or negative with respect to the reference potential, and the power source circuit is arranged so that, in a state of supplying a forward-directional electric current to the luminescent element, it supplies a power source voltage level of positive potential to one terminal functioning as the anode of the luminescent element and supply a power source voltage level of negative potential to the other terminal functioning as the cathode of the luminescent element; and so that, in a state of applying a reverse bias voltage to the luminescent element, it supplies a power source voltage level of negative potential to the one terminal functioning as the anode of the luminescent element and supply a power source voltage level of positive potential to the other terminal functioning as the cathode of the luminescent element; and at least the drive TFT and control TFT are each constructed using the same channel TFT.

2. The device for driving a luminescent display panel according to claim 1, further comprising first switch means for alternatively selecting one of the power source voltage level of positive potential and the power source voltage level of negative potential and second switch means that, in a state where the power source voltage level of positive potential is being selected by the first switch means, selects the power source voltage level of negative potential and, in a state where the power source voltage level of negative potential is being selected by the first switch means, selects the power source voltage level of positive potential, whereby the luminescent element is arrayed between the first switch means and the second switch means.

3. The device for driving a luminescent display panel according to claim 1, wherein the drive TFT and control TFT are each a P-channel type TFT.

4. The device for driving a luminescent display panel according to one of claims 1 to 3, further comprising a capacitor for accumulating an electric charge that maintains a state where the luminescent element is light-up driven by the drive TFT, whereby the device is constructed so that the terminal voltage of the capacitor due to the presence of the electric charge accumulated in the capacitor may be supplied to the gate of the drive TFT.

5. The device for driving a luminescent display panel according to claim 4, further comprising a TFT for making erasable the electric charge of the capacitor.

6. The device for driving a luminescent display panel according to one of claims 1 to 3, which uses as the light-up drive controlling means for the luminescent element any one of a conductance control method, a current mirror method, a current programming method, a voltage programming method, and a threshold voltage correcting method.

7. The device for driving a luminescent display panel according to one of claims 1 to 3, further comprising an element that is connected in parallel to the drive TFT and that, when it is in a state of being applied with a reverse bias voltage, becomes electrically conductive.

8. The device for driving a luminescent display panel according to claim 4, further comprising an element that is connected in parallel to the drive TFT and that, when it is in a state of being applied with a reverse bias voltage, becomes electrically conductive.

9. The device for driving a luminescent display panel according to claim 5, further comprising an element that is connected in parallel to the drive TFT and that, when it is in a state of being applied with a reverse bias voltage, becomes electrically conductive.

10. The device for driving a luminescent display panel according to claim 6, further comprising an element that is connected in parallel to the drive TFT and that, when it is in a state of being applied with a reverse bias voltage, becomes electrically conductive.

11. The device for driving a luminescent display panel according to claim 7, wherein the element that becomes electrically conductive when it is in a state of being applied with a reverse bias voltage is a diode.

12. The device for driving a luminescent display panel according to claim 8, wherein the element that becomes electrically conductive when it is in a state of being applied with a reverse bias voltage is a diode.

13. The device for driving a luminescent display panel according to claim 1, wherein the luminescent element is constructed using an organic EL element the luminescent layer of that is made of an organic compound.

* * * * *